US005567908A

United States Patent [19]

Mc Cubbin et al.

[11] Patent Number: 5,567,908

[45] Date of Patent: Oct. 22, 1996

[54] ADVANCED ANTI SHIP PENETRATOR WARHEAD

[75] Inventors: Melvin J. Mc Cubbin; James A. Weeks, both of Ridgecrest, Calif.; Paul A. Miles, Sterling, Va.

[73] Assignee: The United of America as represented by the Secretary of the Navy, Washington, D.C.

[21] Appl. No.: 146,849

[22] Filed: Apr. 25, 1980

[51] Int. Cl.[6] ..... F42B 12/00

[52] U.S. Cl. ..... 102/519; 102/518

[58] Field of Search ..... 102/495, 515–519

[56] References Cited

U.S. PATENT DOCUMENTS

| | | | |
|---|---|---|---|
| 2,724,334 | 11/1955 | Norton et al. | 102/518 |
| 2,922,366 | 1/1960 | Lyon | 102/52 |
| 3,518,942 | 7/1970 | Philipchuk | 102/56 |
| 3,547,032 | 12/1970 | Horwath, Jr. | 102/67 |
| 3,561,363 | 2/1971 | Birkigt | 102/52 |
| 3,880,083 | 4/1975 | Wasserman et al. | 102/519 |
| 3,946,676 | 3/1976 | Hayes | 102/517 X |
| 3,967,553 | 7/1976 | Keraus et al. | 102/495 X |
| 3,992,998 | 11/1976 | Cordle et al. | 102/56 R |
| 4,016,411 | 8/1978 | Borcher et al. | 102/67 |

*Primary Examiner*—Peter A. Nelson

*Attorney, Agent, or Firm*—Melvin J. Sliwka; John L. Forrest, Jr.

[57] ABSTRACT

An anti ship warhead utilizing a reactive case is disclosed. The case is a magnesium alloy which increases the blast damage once the warhead moves into the interior of a target. Moreover, the nose plate is hardened steel specially designed to cause ripping and tearing of the exterior wall as the warhead penetrates.

10 Claims, 2 Drawing Sheets

ADVANCED ANTI SHIP PENETRATOR WARHEAD

BACKGROUND OF THE INVENTION

This invention relates to warheads, especially with regard to warheads of armor piercing capability. More specifically, it relates to an improved design of such a warhead that not only has greater piercing capability but also produces greater destructive force once through the target outer armor.

It has long been a challenge of amunition makers involved in making ammunition for Naval warfare to develop a warhead that would inflict substantial damage on an opposing ship. This challenge envolved in developing over the years projectiles of varying shapes, degrees of hardness, and explosive carrying capability.

One initial response to the challenge was to engineer an armor piercing projectile. This was a solid steel projectile without an explosive charge or fuze. It was made of high carbon alloy steel specially heat treated to penetrate armor. Another type of warhead was a high explosive, anti-tank penetrator. This penetrator was based on the shaped charge principles (i.e. where a shaped explosive charge was oriented so that it directed a jet of metallic particles from the inside against the target at for a very high velocity) found so useful in defeating heavily armored tanks. The degree of penetration was not a function of the impact velocity for this warhead.

After ordnance engineers built projectiles that could, under size and weight limitations, penetrate naval armor, the problem then became how to maximize the damage inflicted once the warhead reached the interior of the target. The warhead had to carry an explosive, and that explosive had to detonate inside the ship and generate the maximum heat of combustion and, therefore, pressure.

Typically, steel cased projectiles are used to carry the explosive through the outer armor and to prevent premature detonation of the explosive before the warhead reaches the interior. For example, one prior art warhead uses a cylindrical metal casing and a modified nose plate to achieve a degree of superiority. This warhead is still limited though, in that for the size and weight combination, it utilizes an inert casing which provides only minimal damaging effect once inside the ship. The casing itself does not contribute to the heat of combustion and consequent pressure rise caused by released energy.

SUMMARY OF THE INVENTION

The present invention utilizes a reactive case warhead comprised of magnesium, aluminum, zinc and zirconuim that is made in such a manner as to maximize blast damage once the warhead penetrates the external shell of a target. The warhead employs a hardened steel front plate made in such a way to penetrate the walls of the target and that is specially shaped to insure a ripping or tearing of the exterior walls as the warhead enters. An end-loaded fuze ignites the explosive charge and reactive case at the proper time.

OBJECTS OF THE INVENTION

It is therefore an object of this invention to provide an explosive warhead that will cause more damage in the interior of a target ship than do presently used warheads.

Another object of the invention is to provide such an explosive warhead wherein the structural casing is also a reactive casing that will contribute to the damage inflicted.

Still another object of the invention is to provide such an explosive warhead wherein such a reactive casing is also strong enough to survive impact with the outer armor and penetrate into the interior of the target ship.

A still further object of the invention is to provide a warhead that will upon impact with the exterior deck rip or tear the outer plates as it passes through.

These and other objects of this invention will appear from the following specification, and are not to be construed as limiting the scope of the invention thereto, since in view of the disclosure herein, others may be able to make additional embodiments within the scope of the appended claims.

DESCRIPTION OF THE PREFERRED EMBODIMENT

Figure 1:
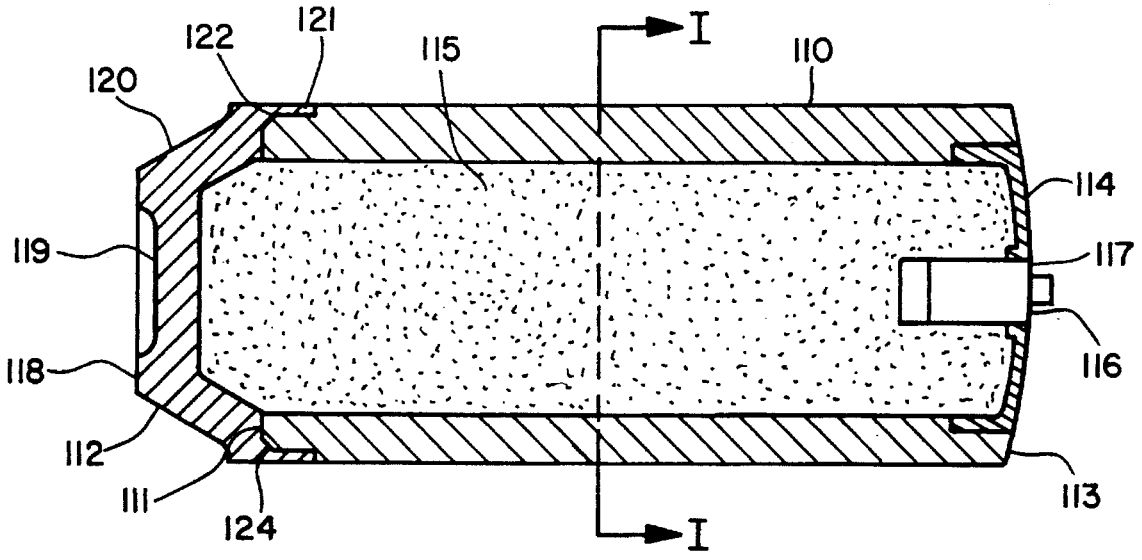
FIG. 1 is a sectional side view of the reactive case warhead with an improved steel penetrator.
Figure 2:
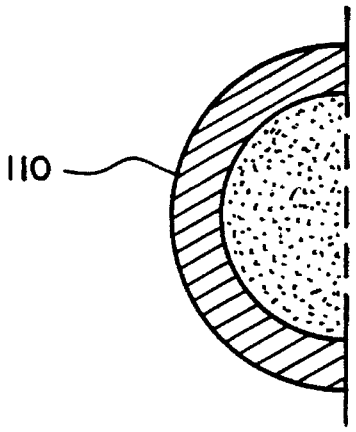
FIG. 2 is a sectional view of the projectile of the invention taken along lines I—I of FIG. 1.

The present invention is illustrated in FIG. 1. The invention is a reactive case warhead with an improved nose-plate penetrator. The warhead is constructed from a magnesium alloy reactive case 110 in the form of a hollow cylinder (Fig, 2). Case 110 has a front end 111 and an aft end 113 with a prehardened steel penetrator 112 and a conventional end plate 114, respectively, attached thereto. Case 110 is filled with an explosive 115 and a fuse 116 is placed in a centrally bored aperture 117 in end plate 114. The increased explosive capacity of the magnesium alloy case is explained below.

Steel penetrator 112 is designed to open up a hole in the exterior deck and tear or rip the structure as the warhead passes through. Penetrator 112 is made of a prehardened steel, typically found in the industry, and has a flat frontal surface 118 with a shallow indentation 119 in the center thereof. This shallow indentation allows for a reduced weight of the penetrator 112 over prior art warheads. The sidewalls 120 are slanted outwardly and rearwardly from front surface 118 and give the penetrator a cuplike appearance. The rearward most lip 121 of sidewall 120 overhangs the forward end of reactive case 110. Penetrator 112 is securely attached to the front end of reactive case 110 along the inside surface of lip 121 and at the indented surface 124 of sidewall 120. The exterior corner 122 of the forward end of case 110 is bevelled to reflect the curve of indented surface 124.

Figure 3:
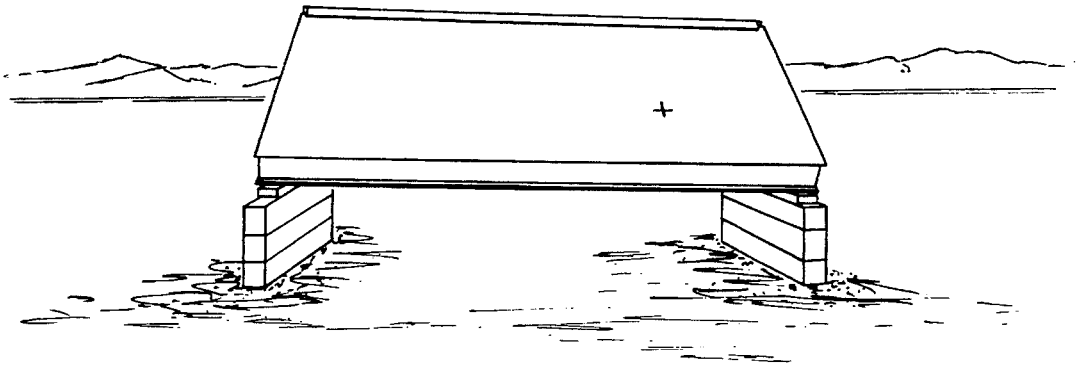
FIG. 3 is a front view of the test target.
Figure 4:
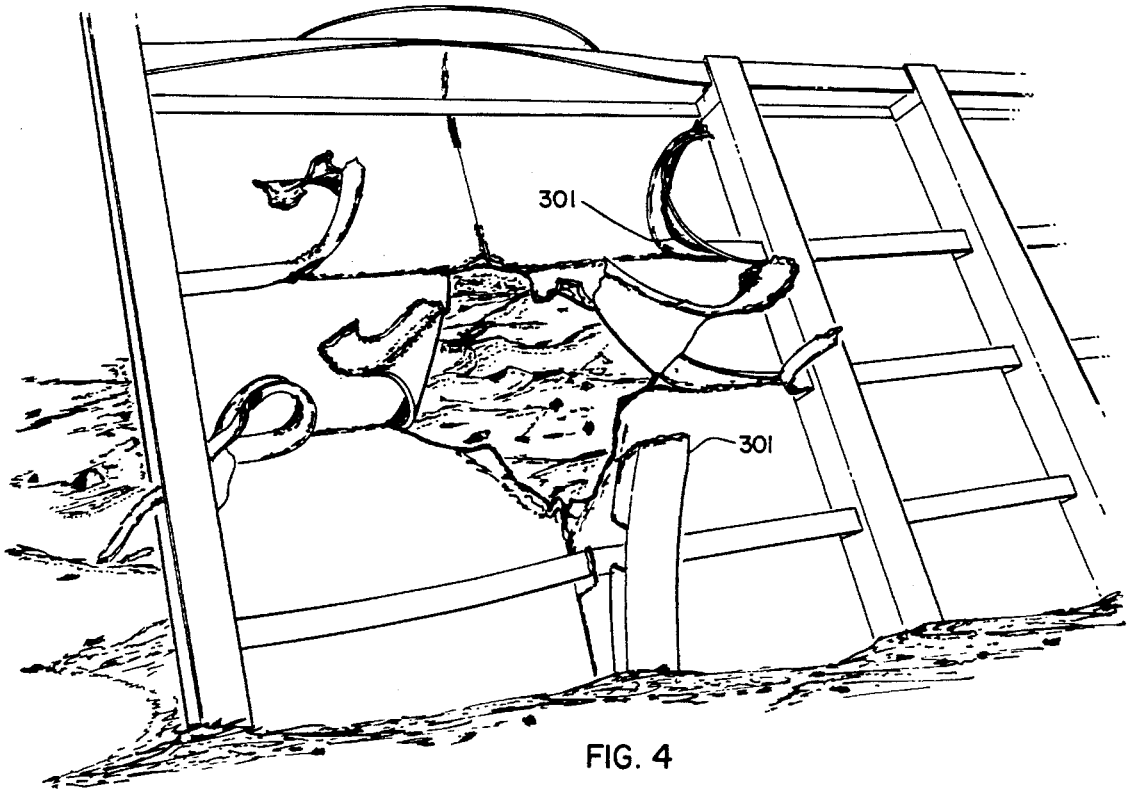
FIG. 4 is a rear view of the test target after impact by the improved penetrator.

Testing has confirmed that the above described penetrator design achieves a more damaging entry through the exterior decks of a target. FIG. 3 shows the test target before being hit by the improved penetrator. As seen in FIG. 4, the new penetrator severely ripped through the target, which was constructed to simulate the exterior or side of the ship and peeled back the steel ribs (as shown at 301). This new prehardened steel penetrator thus insures a more damaging entry into the interior of the target ship.

Naval testing has demonstrated the improved performance of a magnesium alloy (MAG) reactive case. The warhead was designed to provide enhanced blast damage throughout the interior of a target be it a ship or other structure. The reactive case warhead as seen in FIG. 1 increases the blast damage over that caused by conventional, inert (i.e. steel) cased warheads by adding the combustion of the reactive metal case in thee ambient oxygen of the surrounding environment to that of the main charge or explosive 115 packed inside the case. The main charge detonation causes a shock wave which compressively heats the reactive case metal, causes it to fracture into small fragments, and accelerates these fragments to a high velocity. The burning occurs in the surrounding atmospheric oxygen, and is initiated by the hot products in the main charge fireball, by aerodynamic drag frictional forces, and by frictional and impact forces generated during impact of the fragments with the adjacent target walls and structure and other burning fragments.

Testing of the MAG reactive case investigated the following parameters: internal blast as measured through quasi static peak pressure and total impulse; bubble energy; and underwater shock. These tests were conducted in a detonation chamber, and the MAG reactive case and explosive was compared to an explosive charge from a conventional warhead. Table I presents the results:

TABLE I

| | INTERNAL BLAST* | | | UNDER- |
|---|---|---|---|---|
| REACTANT WEIGHT | QUASI-STATIC | TOTAL IMPULSE | BUBBLE ENERGY* | WATER SHOCK* |
| 330 lbs. Des. 287 lbs MAG | 734 | 882 | 543 | 450 |
| 215 lbs Des. Inert Case | 256 | 256 | 337 | 258 |

*Equivalent TNT weight, lbs.

The MAG reactive case is manufactured from either extruded magnesium alloy bar stock where the alloy was made from magnesium, zinc, and zirconium or from forged magnesium alloy material. The cases were all produced in accordance with MIL-SPECQQ-M-31, WW-T-825, and QQ-M-40, which may be referred to for manufacturing details.

Further Navy testing involved detonating individual warheads inside of target vessels. The MAG reactive warheads were again compared to conventional steel warheads. The warheads were detonated in both stern and bow areas of the vessel. An advantage of the MAG reactive warhead is that, unlike the steel warhead where any fragment damage is limited to the blast envelope, the reactive casing expands the blast envelope, thereby causing damage outside of the room wherein the warhead explodes.

When the warheads were detonated in the bow, the MAG reactive warhead demonstrated a capability of inflicting a 1.5 times greater damage than the equivalent total and explosive weight steel case warhead. When compared to a steel case warhead having a 30% greater total weight and an equal explosive weight, the reactive case warhead demonstrated a 1.25 times greater damage capability. The MAG reactive case warhead inflicted about equal damages when compared to a steel case warhead of nearly twice the total weight. Similar results ocurred when the warheads were detonated in the stern areas.

It will be understood that various changes in the details, materials, steps and arrangements of parts, which have been herein described and illustrated in order to explain the nature of the invention, may be made by those skilled in the art within the principle and scope of the invention as expressed in the appended claims.

What is claimed is:

1. An anti-ship warhead comprising:

a reactive casing having a forward end and an aft end;

a prehardened steel penetrator of a cup-like design having a flat, frontal surface that has a shallow indentation of a predetermined size at the center thereof fixedly attached to said forward end of said casing;

an end plate fixedly attached to said aft end of said casing;

an explosive located inside said casing; and a fuze fixedly attached to said end plate, whereupon impact with a predesignated target said opening means simultaneously opens and tears an entry through the walls of the target and said fuze detonates said explosive and said reactive case generating an increased static peak pressure and impulse over conventional warheads.

2. A warhead as in claim 1 where the reactive casing is constructed from a magnesium-alloy consisting essentially of magnesium, zinc, and zirconuim.

3. A warhead as in claims 1 or 2 where the reactive casing is a forged casing.

4. A warhead as in claims 1 or 2 where the reactive casing is of a hollow, cylindrical shape.

5. A warhead as in claim 4 where the opening and tearing means is a prehardened steel penetrator of a cup-like design having a flat, frontal surface that has a shallow indentation of a predetermined size at the center thereof.

6. A warhead as in claim 4 where the side walls of said penetrator slant outwardly and rearwardly from said frontal surface at a predetermined angle and for a predetermined distance and end in an indented surface that is matingly attached to said forward end of said reactive casing.

7. A warhead as in claim 5 where the side walls of said penetrator slant outwardly and rearwardly from said frontal surface at a predetermined angle and for a predetermined distance and end in an indented surface that is matingly attached to said forward end of said reactive casing.

8. A warhead as in claims 1 or 2 where the reactive casing is an extruded casing.

9. A warhead as in claim 8 where the opening and tearing means is a prehardened steel penetrator of a cup-like design having a flat, frontal surface that has a shallow indentation of a predetermined size at the center thereof.

10. A warhead as in claim 9 where the side walls of said penetrator slant outwardly and rearwardly from said frontal surface at a predetermined angle and for a predetermined distance and end in an indented surface that is matingly attached to said forward end of said reactive casing.

* * * * *